US011311755B2

(12) United States Patent
Blondeau

(10) Patent No.: US 11,311,755 B2
(45) Date of Patent: Apr. 26, 2022

(54) HARNESS

(71) Applicant: ZEDEL, Crolles (FR)

(72) Inventor: Loïc Blondeau, La Tronche (FR)

(73) Assignee: ZEDEL, Crolles (FR)

( * ) Notice: Subject to any disclaimer, the term of this patent is extended or adjusted under 35 U.S.C. 154(b) by 37 days.

(21) Appl. No.: 16/361,759

(22) Filed: Mar. 22, 2019

(65) Prior Publication Data

US 2019/0308040 A1 Oct. 10, 2019

(30) Foreign Application Priority Data

Apr. 5, 2018 (FR) ..... 1852985

(51) Int. Cl.
*A62B 35/00* (2006.01)

(52) U.S. Cl.
CPC ..... *A62B 35/0031* (2013.01); *A62B 35/0025* (2013.01)

(58) Field of Classification Search
CPC ..... A62B 35/0012; A62B 35/0031; A62B 35/0025
See application file for complete search history.

(56) References Cited

U.S. PATENT DOCUMENTS 4,671,264 A * 6/1987 Frangi ..... A61F 5/24 128/96.1
6,422,242 B1 * 7/2002 Slautterback ..... A61F 5/24 128/846
7,490,610 B2 * 2/2009 Franklin ..... A62B 35/0025 128/869
9,174,071 B2 * 11/2015 Seman ..... A62B 35/0018
2005/0072530 A1 * 4/2005 Petzl ..... A62B 35/0012 160/3
2007/0209869 A1 9/2007 Martin et al.
2008/0011545 A1 * 1/2008 Turner ..... A62B 35/0012 182/6
2009/0026012 A1 * 1/2009 Petzl ..... A62B 35/0025 182/6
2009/0057360 A1 * 3/2009 Demsky ..... A45F 3/047 224/262
2013/0191956 A1 8/2013 Elliott
2013/0319793 A1 * 12/2013 Stibilj ..... A62B 35/0012 182/3
2015/0208791 A1 * 7/2015 Klein ..... A45F 3/08 224/633

FOREIGN PATENT DOCUMENTS

EP 1 834 543 A1 9/2007
EP 2 383 018 A1 11/2011
FR 2796296 B1 * 10/2001 ..... A62B 35/0025
FR 2 842 741 A1 1/2004
WO 2007/045740 A1 4/2007

* cited by examiner

*Primary Examiner* — Alvin C Chin-Shue
(74) *Attorney, Agent, or Firm* — Oliff PLC

(57) ABSTRACT

The roping harness comprises a belt and leg loops. The belt is formed by a first strip and a second strip separated so as to define a housing cavity housing at least one foam comfort pad. The first strip is an inner strip designed to come into contact with the user's back whereas the second strip is an outer strip of the belt. The first strip and second strip are fixed to one another by at least one resistance strap mechanically fixed to a suspension point. The housing cavity comprises at least one opening so that the foam comfort pad is removable from the housing cavity.

13 Claims, 3 Drawing Sheets

HARNESS

FIELD OF THE INVENTION

The invention relates to a roping harness comprising a belt and a pair of leg loops.

STATE OF THE ART

In the field of rock climbing, mountaineering, or ski touring, or for working at a height, roping harnesses ensure the safety of the people involved.

In conventional manner, a roping harness comprises a belt and a pair of leg loops. Depending on the type of use, the belt and leg loops can be more or less thick to provide user comfort. For example, a harness intended for working at height has to be particularly comfortable to be able to be used for a long period. The harness also has to be particularly comfortable when climbing so as not to injure the climber who falls when he is leader on a climbing route.

In the field of mountaineering and ski touring, the harness is mainly intended for roping a climbing team. The thicknesses of the belt and of the leg loops can be smaller as the latter are rarely under pressure. This results in a gain in weight and compactness appreciated by sports persons, but to the detriment of their comfort.

In order to guarantee good conditions of use whatever the field of activity involved, it is important to achieve a trade-off between user comfort, the weight of the roping harness and its compactness. In this way, the harness is general-purpose and the user does not need to procure several different items of equipment. In a large number of activities, it is particularly advantageous to use a harness that is as light as possible, which means choosing astute solutions to gain a few grams. Some light harnesses exist having a design that is conceived to reduce the weight of the harness to the minimum. However, these harnesses are not particularly comfortable which limits their use.

SUMMARY OF THE INVENTION

One object of the invention consists in providing a harness that is light and that provides enhanced comfort in order to increase the conditions in which the harness can be used.

This requirement tends to find a solution by means of a roping harness comprising a belt and leg loops. The harness is remarkable in that the belt is formed by a first strip and a second strip separated so as to define a housing cavity housing at least one foam comfort pad, the first strip being an inner strip designed to come into contact with the user's back whereas the second strip is an outer strip of the belt, the first strip and second strip being fixed to one another by at least one resistance strap mechanically secured to a suspension point. The housing cavity comprises at least one opening so that the at least one foam comfort pad is removable from the housing cavity.

In one development, the harness comprises first and second foam comfort pads. The housing cavity comprises first and second opposite openings along the longitudinal axis of the belt so that the first and second foam comfort pads are removable from the housing cavity respectively via the first and second openings.

Advantageously, the first strip and/or second strip are formed by a netting.

In a particular embodiment, the harness comprises first and second resistance straps defining two opposite ends of the housing cavity in a direction perpendicular to the longitudinal axis of the belt, the first and second resistance straps being mechanically fixed to the suspension point.

It is advantageous to provide for the first strip and second strip to be formed from a material having a Young's modulus lower than a Young's modulus of the at least one resistance strap.

In another development, the roping harness is remarkable in that it comprises a belt and leg loops. At least one leg loop is formed by a first strip and a second strip separated so as to define a housing cavity housing a foam comfort pad, the first strip being an inner strip designed to come into contact with the user's thigh whereas the second strip is an outer strip of the leg loop. The first strip and second strip are fixed to one another by at least one resistance strap secured to a suspension point. The housing cavity comprises at least one opening so that the foam comfort pad is removable from the housing cavity.

Preferentially, the harness comprises first and second resistance straps defining two opposite ends of the housing cavity in a direction perpendicular to the longitudinal axis of the leg loop, the first and second resistance straps being mechanically secured to the suspension point.

A further object of the invention is to provide a method for using the roping harness which enables the weight and comfort of the harness to be adjusted to suit the envisaged use.

This requirement tends to find a solution by means of a method for using a harness according to one of the foregoing embodiments and which comprises the following steps:

extracting a foam comfort pad from the housing cavity, fitting the roping harness on the user.

These requirements also tend to find a solution by means of a method for using a harness according to one of the foregoing embodiments and which comprises the following steps:

inserting a foam comfort pad in the housing cavity, fitting the roping harness on the user.

BRIEF DESCRIPTION OF THE DRAWINGS

Other advantages and features will become more clearly apparent from the following description of particular embodiments given for non-restrictive example purposes only and represented in the appended drawings, in which.

DESCRIPTION OF A PREFERRED EMBODIMENT OF THE INVENTION

Figure 1:
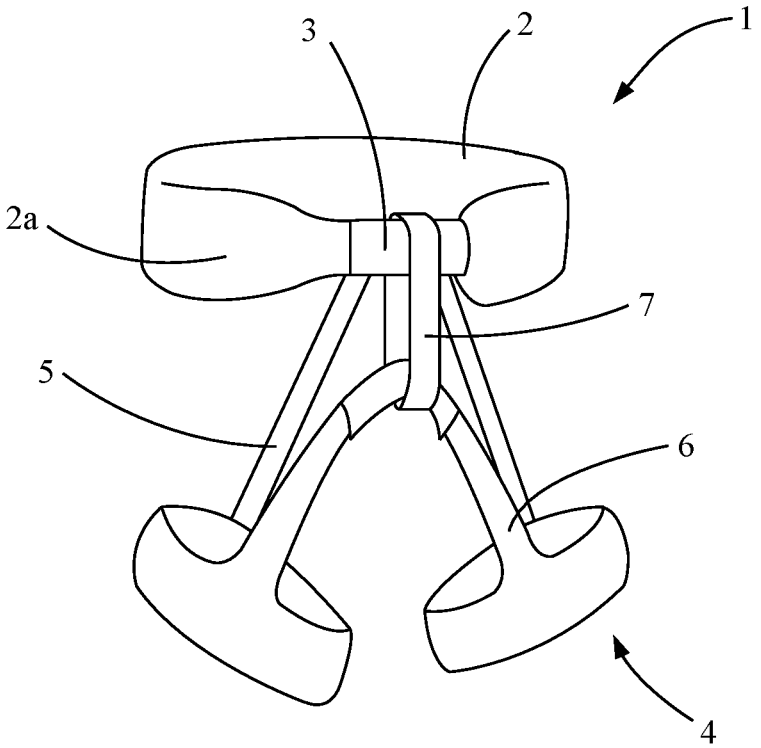
FIG. 1 represents a schematic view of a roping harness.

A roping harness 1 such as the one represented schematically in FIG. 1 comprises a belt 2 provided with a waistband 2*a* associated with an adjustment device 3 of the circumference of the belt 2 and/or with an opening/closing device of the belt 2. It is also possible for the adjustment device 3 of the circumference of the belt to also form the opening/closing device of the belt 2.

The harness 1 also has a pair of leg loops 4, each leg loop 4 being advantageously connected to the dorsal part of the belt 2 by two straps 5 which may be flexible or not, and to the ventral part for example by a hasp 6 via a central ring 7. As an alternative embodiment illustrated in FIGS. 3 and 4, the harness 1 may be devoid of a central ring and hasp, each leg loop 4 being fixed independently to the front part of the belt 2 by means of a strap 8 which can form a part of the leg loop 4.

Figure 3:
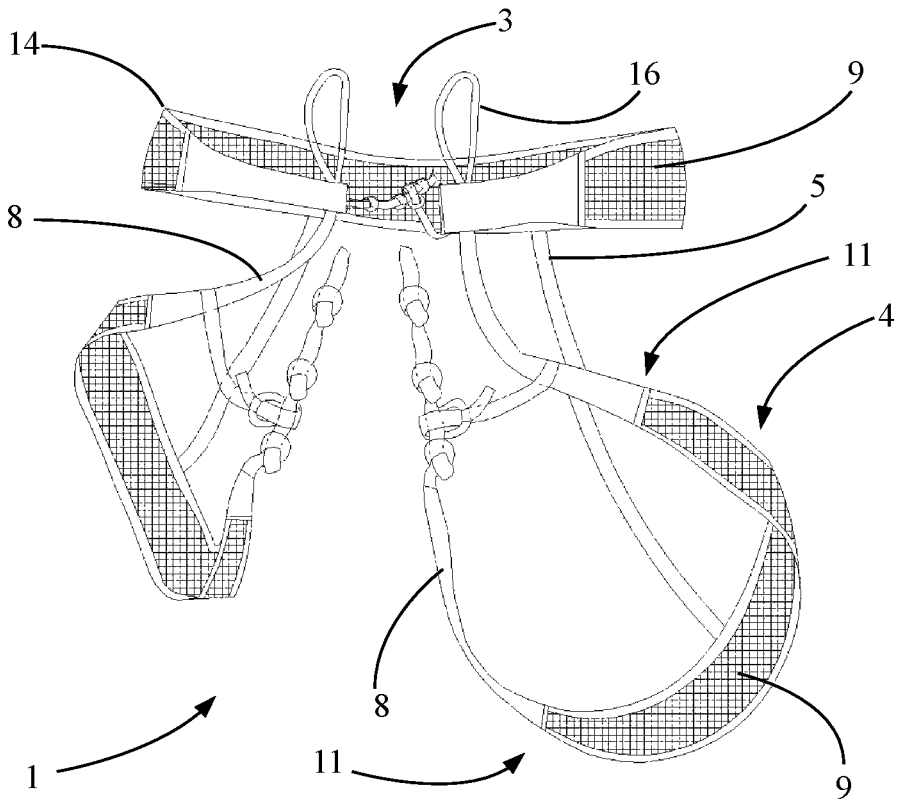
FIG. 3 represents a schematic view of a roping harness according to the invention equipped with foam comfort pads fitted in the belt and in each leg loop.
Figure 4:
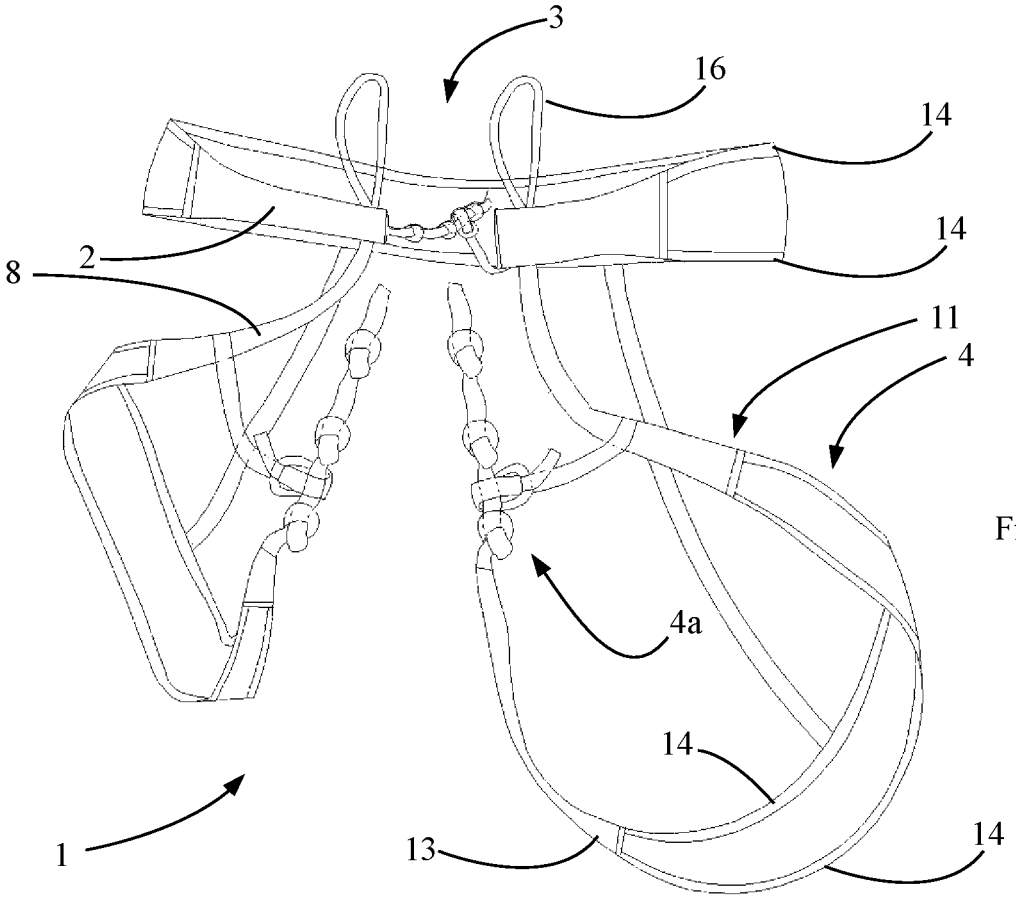
FIG. 4 represents a schematic view of a roping harness not provided with foam comfort pads according to the invention.

In the exemplary embodiment illustrated in FIGS. 3 and 4, each leg loop 4 is associated with an adjustment device 4*a* of the circumference of the leg loop 4 which, in this exemplary embodiment, also acts as opening/closing device of the leg loop 4.

In order to gain weight, the foam comfort pads were eliminated in the prior-art harness and replaced by a netting which increases the contact surface with the user's waist or thigh to prevent the resistance straps from pressing too deeply into the user's flesh. However, this construction makes the harness difficult to endure when the user is suspended in his harness for a long period, which limits its use to activities where the user knows he/she will be suspended in his harness for a limited time only.

This results in the user not using this harness but using another harness in activities where he/she is suspended in the harness for long periods. This means he/she will have to have two harnesses for different activities.

In order to be able to use a harness 1 in a wider range of configurations, it is proposed to use one or more foam comfort pads 9 that are removal. When the foam comfort pad or pads 9 are fitted on the harness 1 as illustrated in FIG. 3, comfort is enhanced and the user can envisage being suspended in his harness 1 for relatively long periods of time.

On the contrary, when the foam comfort pad or pads 9 are removed as illustrated in FIG. 4, the harness 1 is lighter which is an advantage when the user is on long routes and/or when the total weight of the equipment is heavy and has to be reduced.

In order to be able to fit and remove the foam comfort pad or pads 9 easily, it is particularly advantageous to form a cavity 10 for housing the foam comfort pad 9 associated with an opening 11. In this way, by passing the foam comfort pad 9 through the opening 11, the user can fit or extract the foam comfort pad 9 before donning the harness 1. For ease of understanding, the outer strip is represented as being transparent to better highlight the presence of the foam comfort pads in the housing cavity.

Depending on the configurations, the foam comfort pad 9 is fitted in removable manner in the belt 2 of the harness 1 or in a leg loop 4. It is possible to provide for a harness 1 where a foam comfort pad 9 is fitted in removable manner in each leg loop 4 and in the belt 2.

Figures 2A, 2B, 2C:
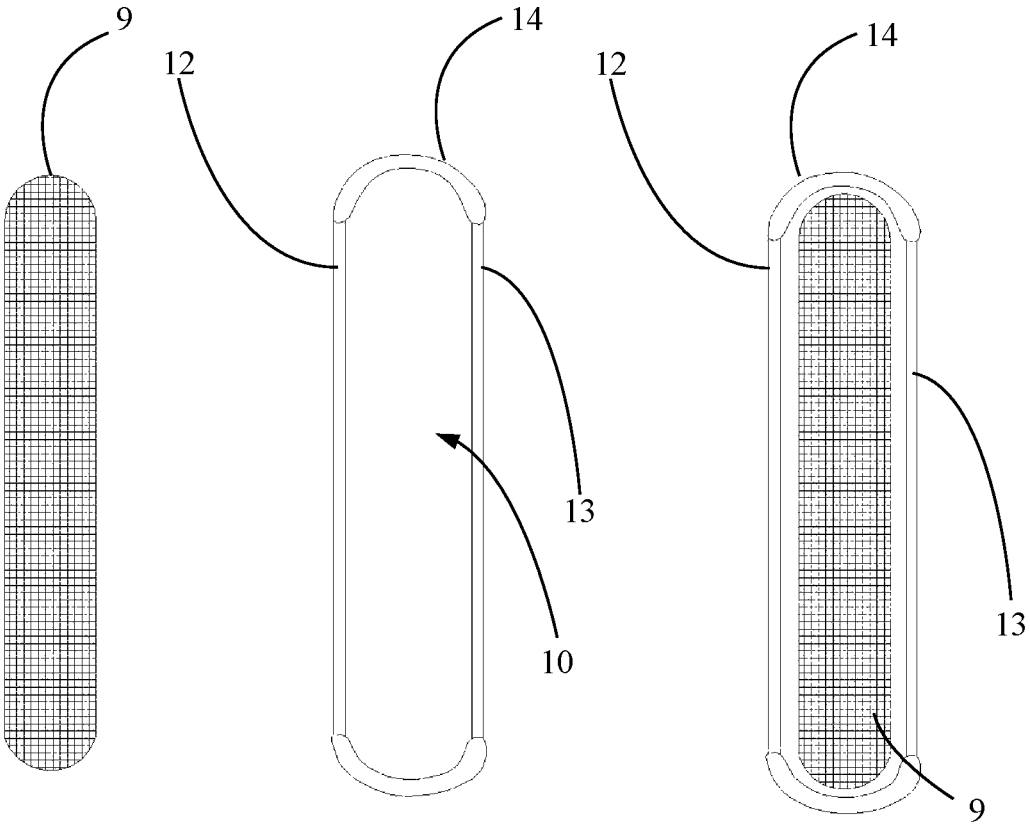
FIGS. 2*a*, 2*b* and 2*c* represent, in schematic manner, in cross-section, respectively a foam comfort pad, a cavity for housing a leg loop or a belt of a roping harness according to the invention, and a foam comfort pad fitted inside a housing cavity.

In a configuration illustrated in FIGS. 2*a*, 2*b* and 2*c*, the belt 2 is formed by a first strip 12 and a second strip 13 separated so as to define the cavity 10 housing at least one foam comfort pad 9. The first strip 12 is an inner strip designed to come into contact with the user's back. The second strip 13 is an outer strip of the belt. The first strip 12 and second strip 13 are fixed to one another by at least one resistance strap 14 mechanically secured to a suspension point preferably a ventral suspension point. The resistance strap 14 passes right around the belt 2 or the leg loop 4 so as to enhance the mechanical strength of the harness in case of a fall. FIG. 2*a* illustrates a foam comfort pad in cross-section and FIG. 2*b* illustrates the housing cavity 10 in cross-section. FIG. 2*c* illustrates the foam comfort pad fitted in the housing cavity.

The housing cavity 10 comprises at least one opening 11 so that the at least one foam comfort pad 9 is removable from the housing cavity 10. In advantageous manner, the opening 11 is defined in the inner strip 12.

In a preferential configuration, the length of the first strip 12 is smaller than the length of the second strip 13 so that at least one end of the first strip 12 defines at least a first opening 10 for insertion/removal of the foam comfort pad 9. Preferably, the inner strip 12 defines first and second opposite openings 11 along the longitudinal direction of the belt 2.

It is particularly advantageous to provide for the foam comfort pad 9 to be separated into first and second foam comfort pads 9. The first foam comfort pad 9 is inserted/removed via the first opening whereas the second foam comfort pad 9 is inserted/removed via the second opening. It is advantageous to use first and second foam comfort pads 9 as this enables the length of the foam comfort pad 9 to be reduced thereby making the latter easier to insert. The two foam comfort pads are consecutive in the longitudinal direction of the belt 2 which is advantageously the insertion/extraction direction of the foam comfort pad 9.

It is also preferable to provide for the belt to be provided with an opening 11 arranged in the dorsal portion and advantageously in the sagittal plane of the harness to facilitate insertion of two foam comfort pads on each side of the opening 11.

In an advantageous embodiment illustrated in FIGS. 5*a*, 5*b*, 5*c* and 5*d*, the foam comfort pad 9 is associated with a grip tab 15 which makes it easier to grasp the foam comfort pad 9 and prevents damage of the latter in the course of the multiple extractions of the foam comfort pad 9 from the housing cavity 10. The grip tab 15 is advantageously formed by a strap sewn onto the foam comfort pad 9.

Figure 5A:
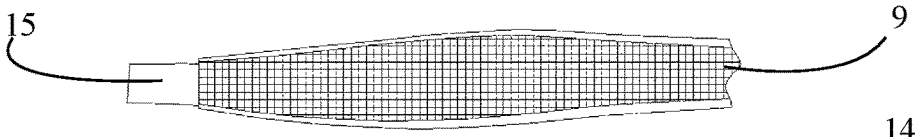
FIGS. 5*a*, 5*b*, 5*c* and 5*d* represent, in schematic manner, in side view, a foam comfort pad, a housing cavity devoid of foam comfort pads, insertion or extraction of a foam comfort pad in or out of the cavity, and a foam comfort pad fitted in a cavity.
Figure 5B:
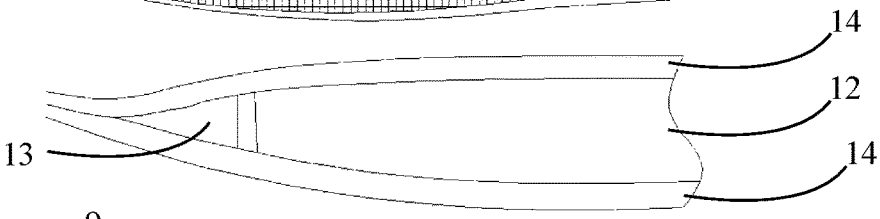
Figure 5C:
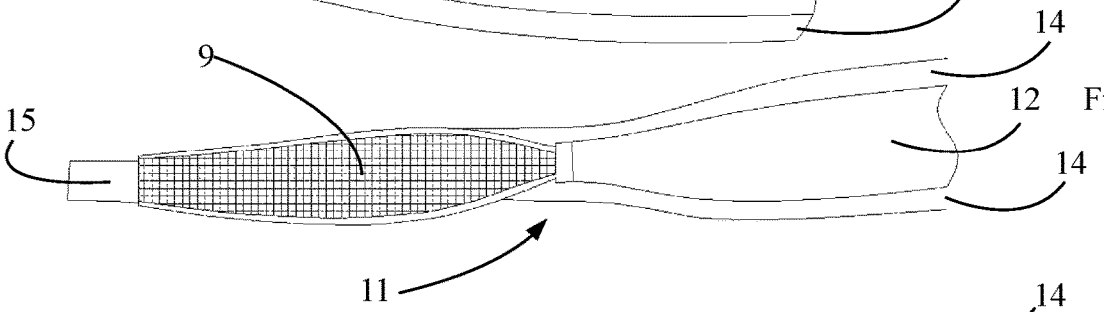
Figure 5D:
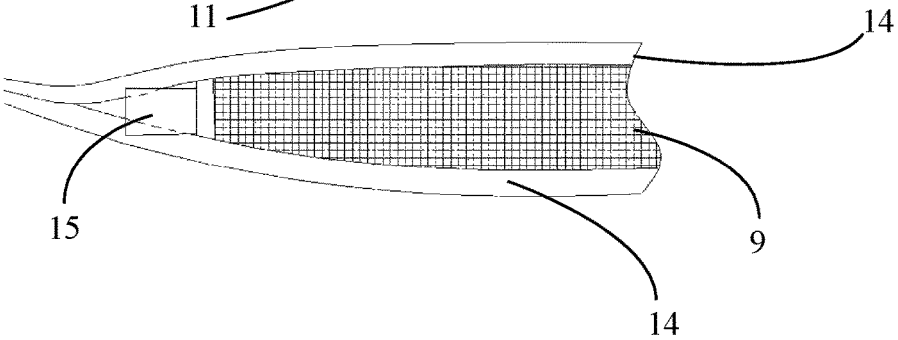

As illustrated in FIG. 5*c*, insertion of the foam comfort pad 9 is then performed by pushing the foam comfort pad 9 towards the sagittal plane of the harness 1 and extraction is performed in the opposite direction at least for the belt 2 advantageously by pulling on the grip tab 15. In advantageous manner illustrated in FIG. 5*d*, the grip tab 15 then protrudes out from the housing cavity 10.

Figure 6A:
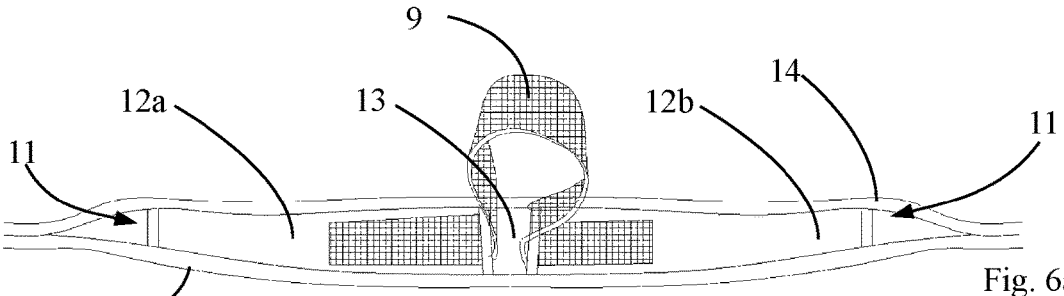
FIGS. 6*a* and 6*b* schematically represent another way of inserting or extracting a foam comfort pad according to another embodiment of a cavity for housing a foam comfort pad and another configuration of a foam comfort pad fitted in a cavity.
Figure 6B:
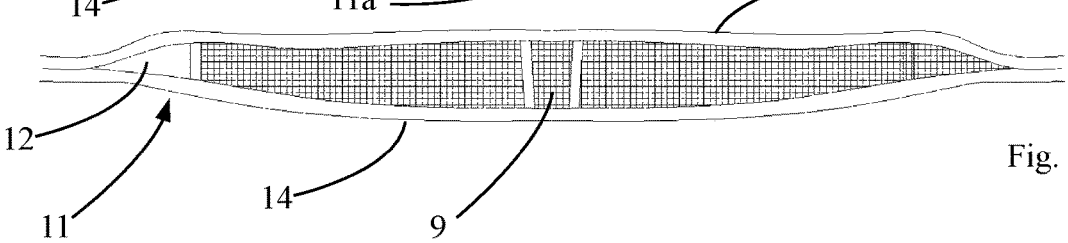

As an alternative, the inner strip 12 can be divided into a first inner strip 12*a* and a second inner strip 12*b* that are separated by a central opening 11*a*. It is then possible to insert/extract the first and second foam comfort pads 9 via the central opening 11. It is also possible to provide a harness 1 that comprises opposite first and second openings 11 in association with the central opening 11. It is also possible to use a single foam comfort pad 9 as illustrated in the embodiment of FIGS. 6*a* and 6*b*.

In order to improve user comfort, the housing cavity 10 has a variable width in the longitudinal direction of the belt 2 or of the leg loop 4 to adjust to the pressure areas that exist when the user is suspended in his/her harness 1. It is particularly advantageous to provide for the width of the belt 2 and of the housing cavity 10 to increase when moving away from the transverse plane in the direction of the sagittal plane in the users back. The foam comfort pad 9 preferentially presents a complementary shape to that of the housing cavity 10 in order to limit the possibility of the foam comfort pad 9 involuntarily slipping out of the cavity.

The inner strip 12 and/or outer strip 13 are advantageously formed by a netting which enhances the air flow through the harness 1 and reduces the weight of the inner strip 12 and/or outer strip 13.

It is particularly advantageous to form the insertion/extraction openings 11 of the foam comfort pads 9 in the inner walls in order to have an outer wall that is as homogeneous as possible thereby reducing the risks of the openings 11 of the harness 1 catching on an obstacle.

It is particularly advantageous to have a harness 1 that is provided with two resistance straps 14 that ensure the mechanical strength of the belt 2 in the longitudinal direction. The two resistance straps 14 define the ends of the housing cavity 9 in a direction perpendicular to the longitudinal axis of the belt 2 in the plane of the outer or inner strip. The inner and/or outer strips, for example in netting form, have a mechanical strength in the transverse direction which enables the two resistance straps 14 to be separated. However, the strength of the inner or outer strip along the longitudinal axis is unable to withstand a fall. The mechanical strength is provided by the resistance strap or straps. In advantageous manner, the first strip 12 and second strip 13 are formed from a material having a Young's modulus lower than the Young's modulus of the resistance strap 14.

The harness 1 is advantageously devoid of shoulder straps in order to reduce the weight of the harness 1 and its overall dimensions.

In the embodiment illustrated in FIGS. 3 and 4, the harness is provided with two rings 16 fitted on the belt 2 and designed to collaborate with a connector, for example a carabiner, a quick link or a rope to close the belt 2 of the harness 1.

In an advantageous embodiment, the outer strip is formed by a fabric having different properties from the fabric forming the inner strip. It is preferable to provide for the outer strip to be formed by a fabric having a abrasion resistance higher than the abrasion resistance of the fabric of the inner strip. It is also advantageous to provide for the outer strip to be formed by a material that presents a Young's modulus higher than the Young's modulus of the material forming the inner strip in order to enhance the rigidity and facilitate securing of the belt or of the leg loop when not being worn. It is also advantageous to provide for the outer strip to be at least partially formed by a mesh in order to limit the weight.

The material forming the inner strip is on the other hand preferentially less rigid so as to promote a pleasant contact with the user's body. Advantageously, the material forming the inner strip in contact with the user has a lower mass density than the material forming the outer strip in order to gain a few grams, as the function of the inner strip is essentially to maintain the foam comfort pads in place.

The invention claimed is:

1. Roping harness comprising a belt and leg loops wherein the belt is formed by a first strip and a second strip separated so as to define a housing cavity housing at least one foam comfort pad, the first strip being an inner strip designed to come into contact with a user's back whereas the second strip is an outer strip of the belt, the first strip and second strip being fixed to one another by a first resistance strap and a second resistance strap mechanically secured to a suspension point, wherein the housing cavity comprises at least one opening so that the at least one foam comfort pad is removable from the housing cavity, wherein the first and second resistance straps each extend along a longitudinal direction of the belt so as to form a ring connected to the suspension point, wherein the at least one opening is located between the first and second resistance straps in a first direction perpendicular to the longitudinal direction so that the at least one foam comfort pad is removable from the housing cavity along a longitudinal axis of the belt, wherein the at least one comfort pad has a longitudinal length along the longitudinal axis of the belt larger than a width along the first direction, and wherein a dimension of the at least one opening along a longitudinal length of the belt is smaller than a dimension of the at least one foam comfort pad along the longitudinal axis of the belt.

2. Roping harness according to claim 1, comprising first and second foam comfort pads and wherein the housing cavity comprises opposite first and second openings arranged along a longitudinal direction of the belt so that the first and second foam comfort pads are removable from the housing cavity respectively via the opposite first and second openings.

3. Roping harness according to claim 1, wherein the first strip and/or second strip are formed by a netting.

4. Roping harness according to claim 1, comprising first and second resistance straps defining two opposite ends of the housing cavity along a direction perpendicular to a longitudinal axis of the belt, the first and second resistance straps being mechanically secured to the suspension point.

5. Roping harness according to claim 1, wherein the first strip and the second strip are formed from a material having a Young's modulus lower than a Young's modulus of the at least one resistance strap.

6. Roping harness according to claim 1, wherein the at least one opening extends across the longitudinal axis of the belt.

7. Roping harness according to claim 1, wherein the at least one opening is configured to allow the at least one foam comfort pad to be inserted along the longitudinal axis of the belt.

8. Method for using the roping harness according to claim 1, comprising the following steps:

extracting a foam comfort pad from the housing cavity, fitting the roping harness on a user.

9. Method for using the roping harness according to claim 1, comprising the following steps:

inserting a foam comfort pad in the housing cavity, fitting the roping harness on a user.

10. Roping harness comprising a belt and leg loops wherein at least one of the leg loops is formed by a first strip and a second strip separated so as to define a housing cavity housing a foam comfort pad, the first strip being an inner strip designed to come into contact with a user's thigh whereas the second strip is an outer strip of the at least one leg loop, the first strip and second strip being fixed to one another by a first resistance strap and a second resistance strap secured to a suspension point, wherein the housing cavity comprises at least one opening so that the foam comfort pad is removable from the housing cavity, wherein the first and second resistance straps each extend along a longitudinal direction of the at least one leg loop so as to form a ring connected to the suspension point, wherein the at least one opening is located between the first and second resistance straps in a first direction perpendicular to the longitudinal direction so that the at least one foam comfort pad is removable from the housing cavity along a longitudinal axis of the belt, wherein the at least one comfort pad has a longitudinal length along the longitudinal axis of the belt larger than a width along the first direction, and wherein a dimension of the at least one opening along a longitudinal length of the at least one leg loop is smaller than a dimension of the at least one foam comfort pad along the longitudinal axis of the at least one leg loop.

11. Roping harness according to claim 10, comprising first and second resistance straps defining two opposite ends of the housing cavity in a direction perpendicular to a longitudinal axis of the at least one leg loop, the first and second resistance straps being mechanically secured to the suspension point.

12. Roping harness according to claim 10, wherein the at least one opening extends across the longitudinal axis of the at least one leg loop.

13. Roping harness according to claim 10, wherein the at least one opening is configured to allow the at least one foam comfort pad to be inserted along the longitudinal axis of the at least one leg loop.

* * * * *